US010022785B2

(12) United States Patent
Piskorski

(10) Patent No.: US 10,022,785 B2
(45) Date of Patent: Jul. 17, 2018

(54) METHOD OF CONTINUOUS CASTING

(71) Applicant: NUCOR CORPORATION, Charlotte, NC (US)

(72) Inventor: Terry Piskorski, Dyersburg, TN (US)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 14/884,852

(22) Filed: Oct. 16, 2015

(65) Prior Publication Data

US 2016/0107226 A1 Apr. 21, 2016

Related U.S. Application Data

(60) Provisional application No. 62/065,319, filed on Oct. 17, 2014.

(51) Int. Cl.

| | |
|---|---|
| ***B22D 11/108*** | (2006.01) |
| ***B22D 11/14*** | (2006.01) |
| ***B22D 11/16*** | (2006.01) |
| ***B22D 41/01*** | (2006.01) |
| ***C21C 7/00*** | (2006.01) |
| *B22D 11/00* | (2006.01) |
| *B22D 1/00* | (2006.01) |

(52) U.S. Cl.

CPC ..... *B22D 11/108* (2013.01); *B22D 11/14* (2013.01); *B22D 11/16* (2013.01); *B22D 41/01* (2013.01); *C21C 7/0025* (2013.01); *C21C 7/0075* (2013.01); *B22D 1/00* (2013.01); *B22D 11/001* (2013.01)

(58) Field of Classification Search

CPC ..... B22D 11/001; B22D 11/108; B22D 11/16; B22D 11/14; B22D 41/01

See application file for complete search history.

(56) References Cited

U.S. PATENT DOCUMENTS 4,394,163 A 7/1983 Collin
5,868,816 A * 2/1999 Michard ..... B22D 11/11 266/209

OTHER PUBLICATIONS

Misra, S., "Hydrogen and Nitrogen Control in Steelmaking at U.S. Steel", The Iron & Steel Technology Conference and Exposition, St. Louis, Mo., Nov. 2009.

* cited by examiner

*Primary Examiner* — Kevin P Kerns
*Assistant Examiner* — Steven S Ha
(74) *Attorney, Agent, or Firm* — Hahn Loeser & Parks, LLP

(57) ABSTRACT

A method of controlling the amount of hydrogen in steel for consistent heat transfer in continuous casting by adding a hydrocarbon to the molten metal. A heat of molten steel is formed in a ladle metallurgy furnace adapted for use in continuous casting. Then, a hydrocarbon is added to the molten metal in the ladle metallurgy furnace in an amount sufficient to increase hydrogen levels in the molten steel for casting. And finally, the molten steel with a desired level of hydrogen is delivered to a caster to continuously cast a steel product.

12 Claims, 6 Drawing Sheets

METHOD OF CONTINUOUS CASTING

This application claims priority to provisional application No. 62/065,319 filed on Oct. 17, 2014.

BACKGROUND AND SUMMARY

This invention relates to the continuous slab casting of steel. In the continuous slab casting of steel, molten steel from a steelmaking ladle is poured indirectly through a subentry nozzle into an oscillating casting mold, and the steel is continuously cast in a semi-finished strand to make a slab, bloom, or billet. The semi-finished shape of the strand is determined by the continuous casting mold with a molten inner core and a solidified outer surface as the strand moves downwardly through the mold. The strand is subjected to secondary cooling upon exiting from the mold until the entire strand is solidified. The strand is then cut into slabs, blooms, or billets.

In the continuous caster, the molten steel flows from the tundish into the mold through a submerged entry nozzle (SEN). The SEN discharges the molten metal into the mold to a selected depth below the surface (the "meniscus") of the melt in the mold. The flow of the molten melt from the tundish is gravitationally fed by the pressure difference between the liquid levels of the tundish and that of the melt in the mold. The melt flow from the tundish may be controlled by a stopper rod which at least partially blocks the exit port to the SEN, or a slide gate that moves across the outlet port of the tundish to the SEN. As the molten metal enters the mold, the steel solidifies at the water cooled mold walls to form a shell, which is continuously withdrawn at the casting speed to produce the steel strand by oscillation of the mold walls.

One of the prime difficulties in such continuous casting of steel is having a uniform and consistent mold heat transfer rate, which affects the final casted steel. The origin of the majority of surface defects in the cast strip is at, or within, a very short distance of the meniscus in the mold. Whether the defects propagate into cracks depends on the heat transfer in the remainder of the mold and events and conditions at and below the mold exit. As such, regulating the heat transfer rate is essential.

The heat transfer rate is can be affected by the amount of dissolved gases, particularly hydrogen, in the molten metal. As such, fluctuation in hydrogen levels in the molten metal may cause defects in the steel product and even breakouts as the steel is casted, which in turn, would increase maintenance costs and decrease productivity.

Excessive hydrogen concentrations may decrease the heat transfer rate through the liquid metal causing various defects and risk possible breakouts in the mold. Due to its high mobility, hydrogen can easily diffuse through the lattice of the steel microstructure. Hydrogen may be picked up by the molten metal through steelmaking additions or processes, several of these could be hydrated lime, wet alloys or excessive furnace slag carry over. Hydrogen may also be picked up by the molten metal from the atmosphere. As shown in FIG. 11 of the paper titled "Hydrogen and Nitrogen in Steel Making at U.S. Steel" published in the November 2009 issue of *Iron & Steel Technology*, higher humidity conditions characteristic of steelmaking facilities located in northern U.S. resulted in higher average hydrogen levels.

Conversely, abnormally low hydrogen concentrations may increase the heat transfer rate of the liquid metal causing various casting defects, such as surface cracks in the finished product. Decrease in hydrogen levels is aggravated by cold and dry weather conditions. It is known that the extent of hydrogen pickup strongly depends on the partial pressure of water vapor (i.e. humidity) in the atmosphere. Since the amount of moisture in the air depends on the temperature and the relative humidity, cold and dry winter days provide conditions for unusually low hydrogen levels when compared to summer days.

Currently, there are known methods for regulating the heat transfer rate by altering the casting conditions in the mold. One of these methods is the variation of the physical composition of the mold powder at the continuous caster. The physical components of the mold powder affects the heat transfer rate. As the mold powder melts and solidifies in the mold, the mold powder interacts with the hydrogen in the molten steel and the glass state of the solidified mold powder is altered, affecting the heat transfer rate of said powder. However, developing mold powders dependent on hydrogen levels requires having an extensive inventory of mold powders of different compositions. Additionally, it requires supervision by a trained operator to select the correct mold powder from the various mold powder compositions to control the hydrogen levels in the mold with different operational conditions.

Previous methods control hydrogen levels by modifying the refining process or by using a downstream degasser. Degassing the steel has proven effective in reducing the hydrogen levels and altering the method and timing of the alloy additions have also proved effective in reducing the hydrogen levels in the produced steel.

Accordingly, there remains a need for a method for increasing the hydrogen levels in steel composition for consistent heat transfer in continuous casting that is both effective and economical.

Presently disclosed is a method of controlling the amount of hydrogen in steel for consistent heat transfer in continuous casting by adding a hydrocarbon to the molten metal. Disclosed is a method of continuous casting comprising the steps of:

a. forming a heat of molten steel in a ladle metallurgy furnace adapted for use in continuous casting;
b. adding a hydrocarbon to the molten metal in the ladle metallurgy furnace in an amount sufficient to increase hydrogen levels in the molten steel for casting; and
c. delivering the molten steel with a desired level of hydrogen to a caster to continuously cast a steel product.

The hydrocarbon may be delivered to the molten steel in the ladle metallurgy furnace in an amount sufficient to provide between 5 and 9 ppm of hydrogen in the molten steel delivered to the caster for continuous casting into a steel product. Alternatively, the hydrocarbon may be delivered to the molten steel in the ladle metallurgy furnace in an amount sufficient to provide between 6 and 8 ppm of hydrogen in the molten steel delivered to the caster for continuous casting into a steel product.

The hydrocarbon may be methane. The hydrocarbon may be delivered to the molten metal in the ladle metallurgy furnace by bottom stirring. In some embodiments, the hydrocarbon may be stirred at a rate of 15 SCFM. In other embodiments, the hydrocarbon may be stirred at a rate of 20 SCFM.

Also disclosed is a method of continuously casting comprising the steps of:

a. forming a heat of molten metal in a ladle metallurgy furnace adapted for use in continuous casting;

b. adding a hydrocarbon to the molten metal in the ladle metallurgy furnace in an amount sufficient to increase hydrogen levels in the molten metal;

c. assembling a casting mold for continuous casting;

d. introducing the molten metal into the casting mold and forming a cast strand;

e. delivering the cast strand to a support roller assembly for cooling; and f. forming a slab of continuous cast steel product.

The hydrocarbon may be delivered to the molten steel in the ladle metallurgy furnace in an amount sufficient to provide between 5 and 9 ppm of hydrogen in the molten steel delivered to the caster for continuous casting into a steel product. Alternatively, the hydrocarbon may be delivered to the molten metal in the ladle metallurgy furnace in an amount sufficient to provide between 6 and 8 ppm of hydrogen in the molten steel delivered to the caster for continuous casting into a steel product.

The hydrocarbon may be methane. The hydrocarbon may be delivered to the molten metal in the ladle metallurgy furnace by bottom stirring. In some embodiments, the hydrocarbon may be stirred at a rate of 15 SCFM. In other embodiments, the hydrocarbon may be stirred at a rate of 20 SCFM.

BRIEF DESCRIPTION OF THE DRAWINGS

In order that the invention may be more fully explained, illustrative results of experimental work carried out to date will be described with reference to the accompanying drawings in which.

DETAILED DESCRIPTION OF THE DRAWINGS

Figure 1:
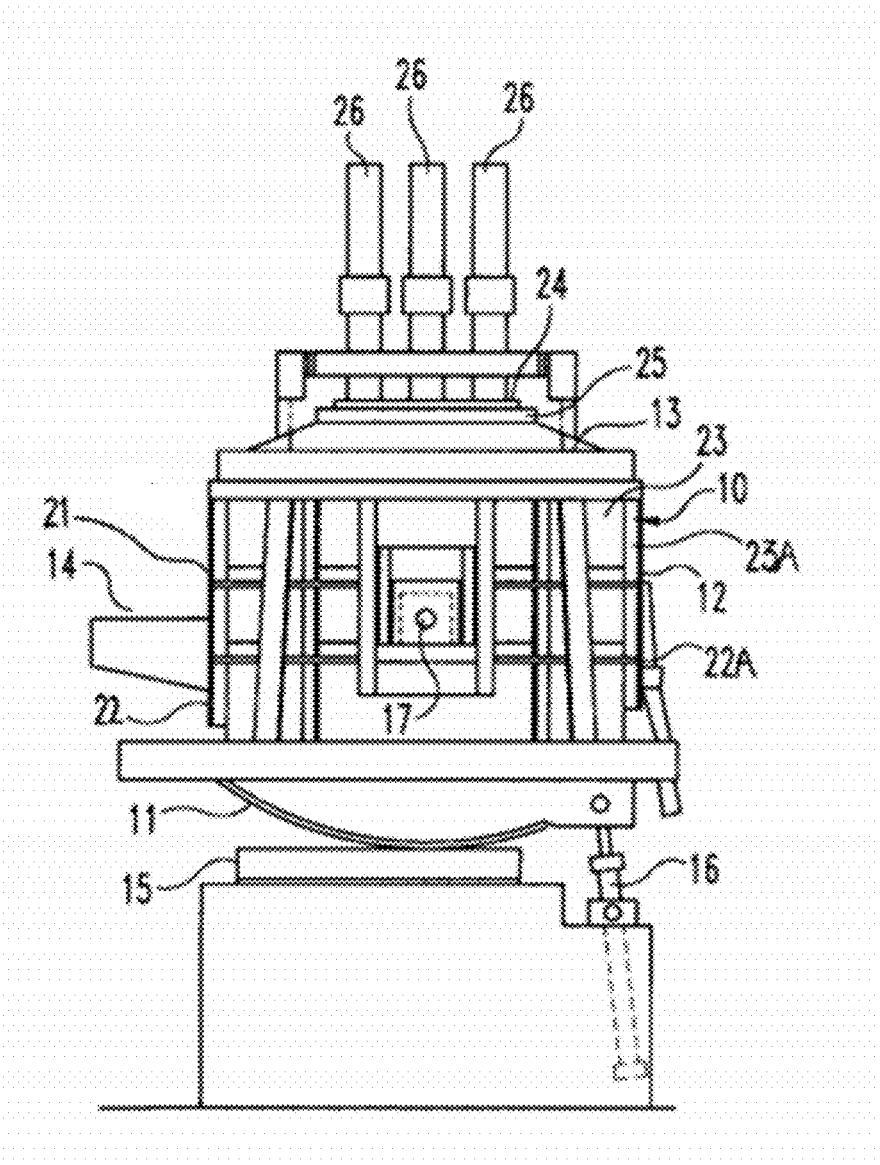
FIG. 1 is a side view of an electric arc furnace.
Figure 2:
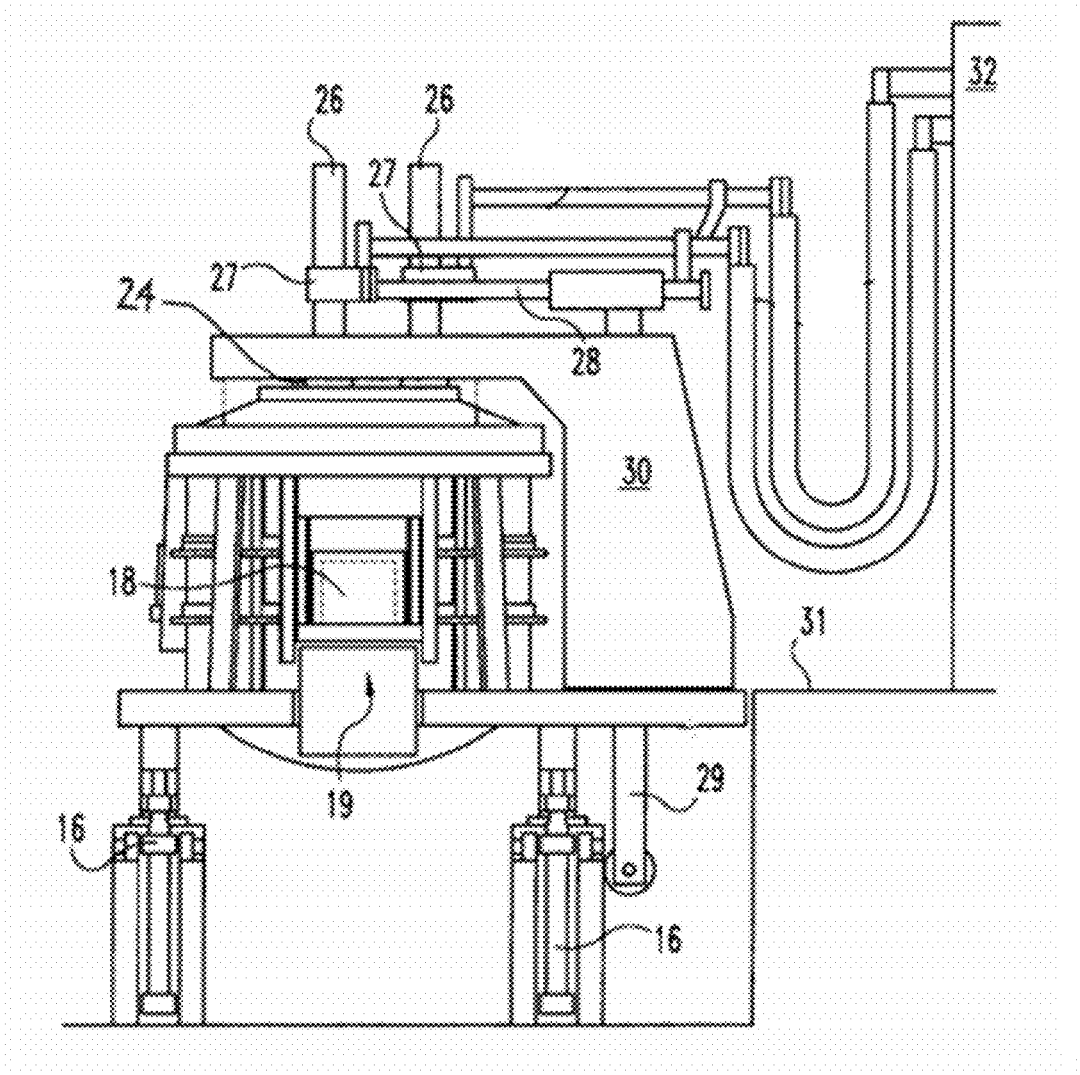
FIG. 2 is a back view of an electric arc furnace.

Molten steel for steel making is made mostly from scrap melt in an electric arc furnace. Referring to FIGS. 1 and 2, electric arc furnace 10 is generally cylindrical in shape, and has a generally spherical curvilinear shaped bottom 11, sidewalls 12, and a roof 13. The bottom 11 and the sidewalls 12 of the furnace are generally refractory lined to above the slag line. The electric arc furnace also has a taphole/spout 14. The electric arc furnace rests on a rocker rail 15, and is capable of being tilted by hydraulic cylinders 16 to discharge the resulting molten metal from the furnace through spout 14.

Provided is a slide door 17 for charging and a backdoor 18 with a slag apron 19 for discharging the slag from the furnace. The electric arc furnace 10 may have a split shell top portion 21 including a roof 13 capable of being quickly decoupled and removed from a bottom portion 22. This facilitates and reduces downtime due to change out of the top portion 21 of the furnace, and provides for rapid relining of the bottom 11 and side walls 12 in bottom portion 22 of the furnace. A sill line 22A divides the upper portion 21 from the bottom portion 22 of the electric arc furnace.

The sidewalls 12 above the slag line are usually comprised of water-cooled panels 23 supported by a water-cooled cage 23A. The furnace roof 13 is also comprised of water-cooled panels with the center section of roof 13 surrounding the electrode ports 24 (called the roof delta 25), generally a cast section of refractory, which may be also water-cooled. Electrodes 26 extend through the electrode ports 24 into the furnace. The electrodes 26 are supported by electrode holders 27, electrode mast arms 28, and electrode mast 29. Roof 13 of the furnace may be removed and supported by jib structure 30, which may be supported by the operating floor level structure 31. The transformers (not shown), housed in an electrical equipment vault 32, supply the electrical current to the electrodes 26 and the steel melt in the electric arc furnace.

Figure 3:
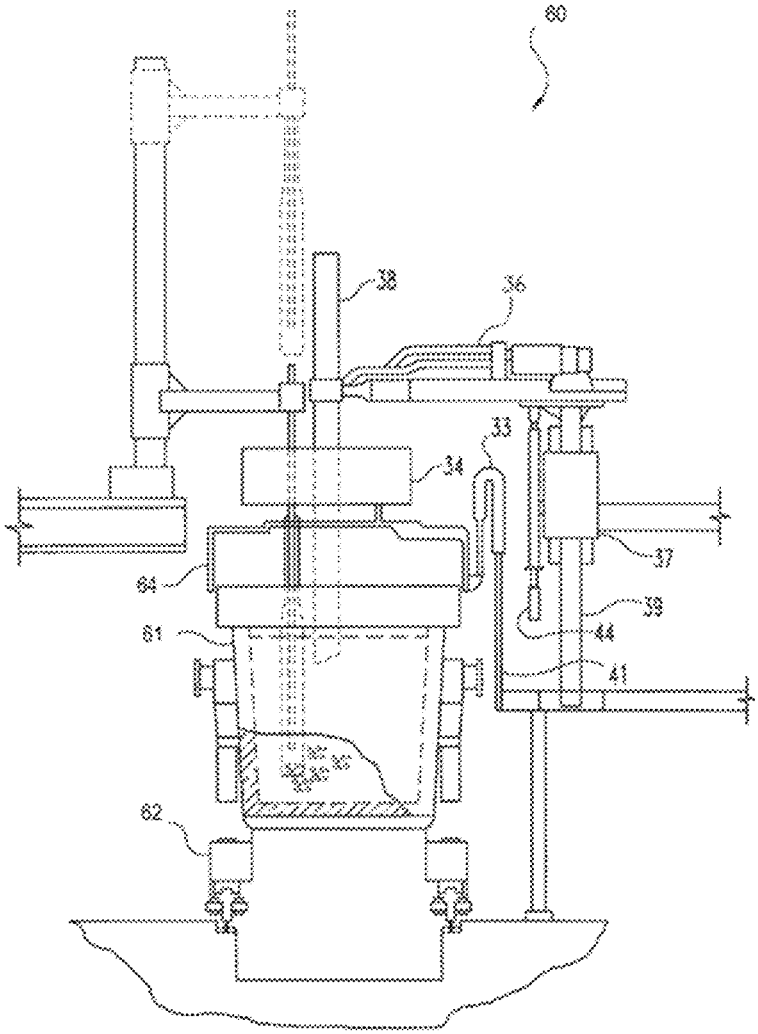
FIG. 3 is a side view of a ladle metallurgy furnace.

Referring now to FIG. 3, the steel is heated within the electric arc furnace with one or more electrodes 38. Electrode 38 is supported by a conducting arm 36 and an electrode column 39. Conducting arm 36 is supported by electrode column 39, which is movably disposed within support structure 37. Current conducting arm 36 supports and channels current to electrode 38 from a transformer (not shown). Electrode column 39 and regulating cylinder 44 are configured to move electrode 38 and conducting arm 36 up, down, or about the longitudinal axis of column 39. Regulating cylinder 44 is attached to support structure 37 and is configured with a telescoping shaft. In operation, as column 39 lowers, electrode 38 is lowered through an aperture (not shown) in furnace hood or exhaust 34 and an aperture (not shown) in furnace lid 64 into the furnace and beneath the slag in order to heat the metal within the furnace. Hydraulic cylinder 33 moves lid 64 and hood 34 up and down from the raised position to the operative lowered position. Heat shield 41 protects the electrode support and regulating components from the heat generated by the furnace. While only one electrode 38 is shown, typically two or three electrodes 38 may be provided for heating operations. Various furnace components, such as, for example, the lid 64, the lift cylinder 33, and the conducting arm 36, are water-cooled. Other suitable coolants and cooling techniques may also be employed.

Once the heat is completed in the furnace and discharged through the shroud, the molten metal is tapped through the bottom of the furnace into a ladle 61 and transferred to a ladle metallurgy furnace 60 on a ladle car 62, which is configured to move the ladle from the ladle metallurgy furnace 60 along the factory floor 63 to a caster (not shown). The molten steel is then delivered from the ladle metallurgical furnace after trimming, as discussed below, to the continuous slab caster.

Figure 4:
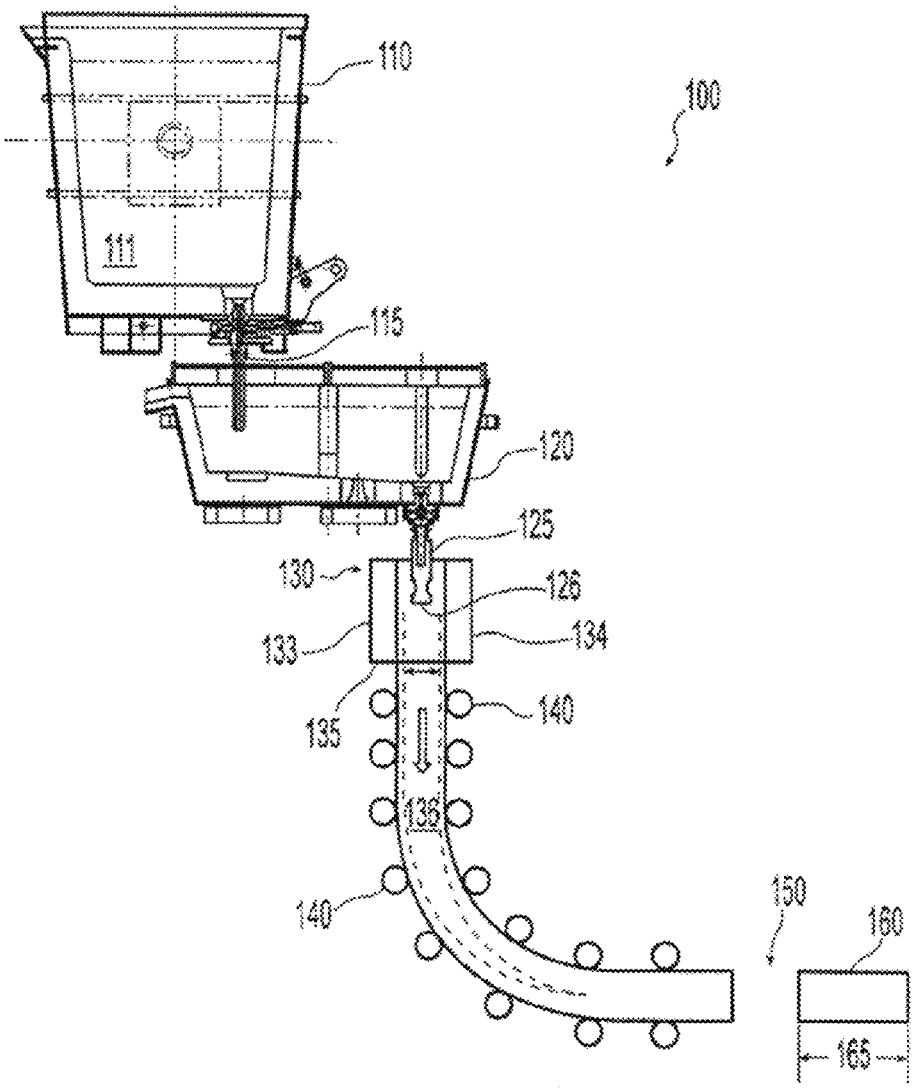
FIG. 4 illustrates a steel slab caster having a caster mold.

FIG. 4 illustrates a continuous slab caster 100 having a caster mold 130. The caster mold 130 is typically oscillating to facilitate downward movement of the molten metal through the mold 130. The steel slab caster 100 pours molten steel to a tundish 120 through a shroud 115, which directs the molten steel 111 to the caster mold 130 through a submerged entry nozzle (SEN) 125 connected to a bottom of the tundish 120. The caster mold 130 includes at least two opposing mold faces (not shown), which are moveable in a oscillatory motion, and mold faces 133 and 134 which may be fixed or moveable.

The cast strand 136 leaves the caster mold through a support roller assembly 140 adjacent broad mold faces 133 and 134 in a generally horizontal direction, which directs the cast strand to a cutting point 150 as the strands cools to a solid form. During casting, water (or some other coolant) is circulated through the caster mold 130 to cool and solidify the surfaces of the cast strand 136. Each time the strand 136 is cut at the cutting point 150, a solid slab 160 is formed having a predetermined length 165.

Before the molten metal is delivered to the caster, the molten steel composition is trimmed in the ladle metallurgy furnace to the exact chemistry desired for casting in the continuous caster. Hydrogen levels in the molten steel may vary with the atmospheric humidity at the steel making plant, which varies generally with the season of the year. For example, FIG. 5 shows hydrogen levels in ppm in molten metal and total BTU at a steel plant measured throughout the course of one year (i.e. from January 2010 to January 2011).

Figure 5:
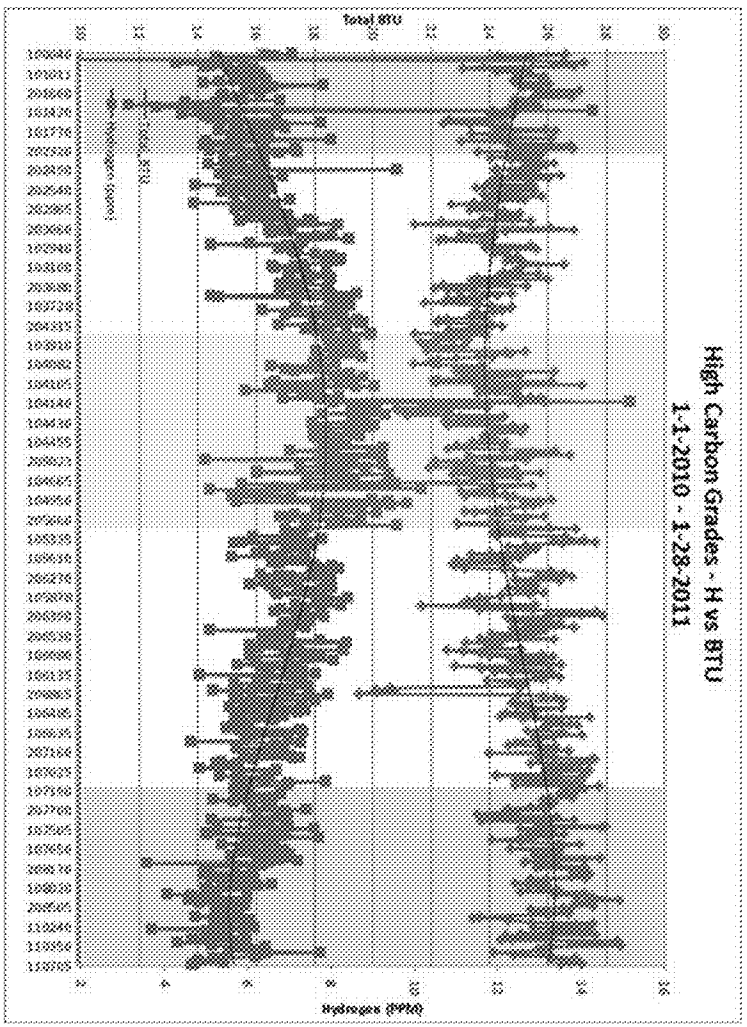
FIG. 5 is a graph showing hydrogen levels in molten metal and total BTU.

As illustrated in FIG. 5, hydrogen levels (represented by square notations in the lower graph) are elevated during the summer season reaching as over 10 ppm. and significantly reduced in the winter season, decreasing as low as 3 ppm.

As illustrated by the upper graph in FIG. 5, the fluctuation or irregularity in hydrogen levels affects the heat transfer rate or the total BTU (represented by diamond notations) in the mold. As hydrogen levels increase, the total BTU or heat transfer rate in the mold decreases. Conversely, as hydrogen levels decrease, the total BTU or heat transfer rate in the mold increases. This inconsistency in hydrogen levels impact the heat transfer rate causing inconsistent practices and performances.

A hydrocarbon may be added to the molten metal in the ladle to control the hydrogen levels for consistent heat transfer as needed and desired. Hydrocarbon refers to any of a class of organic chemical compounds composed only of the elements carbon (C) and hydrogen (H). The addition of hydrocarbon to the molten metal increases hydrogen levels. The hydrogen and carbon of the hydrocarbon disassociate, increasing hydrogen levels in the molten steel.

The hydrocarbon may be stirred through the bottom of the ladle and into the molten metal. A hydrocarbon, such as methane, may be added to the molten metal in the ladle metallurgy furnace in an amount sufficient to provide between 5 and 9 ppm, or alternatively between 6 and 8 ppm, of hydrogen in the molten metal.

Figure 6:
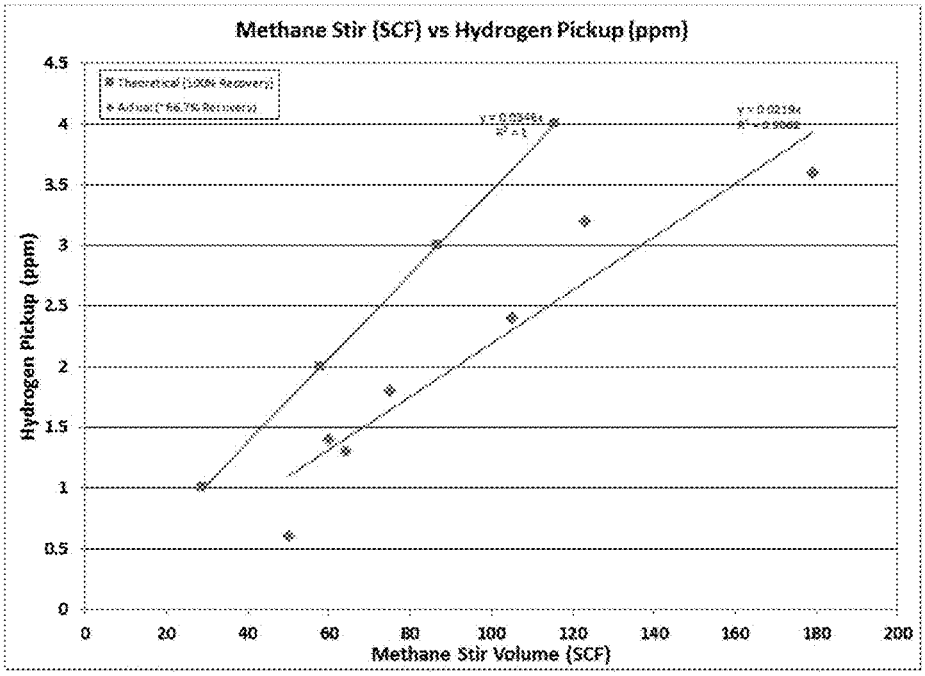
FIG. 6 is a graph showing the correlation between methane and hydrogen levels.

FIG. 6 shows the relationship between hydrogen levels and methane addition to the molten metal. Levels of hydrogen were measured before and after methane was stirred into the molten metal. The hydrogen level increased (i.e. "hydrogen pickup") by 1 ppm per 45 SCF of methane stirred into the molten metal.

The theoretical and actual recovery rates were also determined. The theoretical recovery is identified with square notations. The actual recovery is identified with diamond notations. As FIG. 6 shows, a 62% recovery rate was obtained for a hydrogen pickup of 1 ppm with approximately 45 SCF of methane stirred into the molten metal.

Furthermore, several tests were performed varying the flow rates at which methane was added and stirred into the molten metal. We found that the slower the flow rate, the better the recovery. For example, a flow rate of 15 SCFM with a methane flow volume of 35 SCF for 1 ppm hydrogen results in 83% recovery rate. A flow rate of 20 SCFM with a methane flow volume of 42 SCF for 1 ppm hydrogen results in 69% recovery rate. Whereas, more than doubling the flow rate to 50 SCFM with a methane flow volume of 47 SCF for 1 ppm hydrogen resulted in 62% recovery rate.

While the invention has been described with reference to certain embodiments it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments falling within the scope of the appended claims.

What is claimed:

1. A method of controlling heat transfer in continuous casting comprising the steps of:

forming a heat of molten metal having a hydrogen level below a desired amount in a ladle of a metallurgy furnace adapted for use in continuous casting;

adding a hydrocarbon through a bottom portion of the ladle and into the molten metal; and stirring the hydrocarbon in the molten metal to increase the hydrogen level in the molten metal to the desired amount of between 5 and 9 ppm of hydrogen; and delivering the molten metal to a continuous caster and continuously casting steel.

2. The method of controlling heat transfer in continuous casting as claimed in claim 1, wherein the hydrocarbon is methane.

3. The method of controlling heat transfer in continuous casting as claimed in claim 2, wherein the hydrocarbon delivered to the molten metal is stirred in the ladle at a flow rate of 15 SCFM with a methane flow volume of 35 SCF.

4. The method of controlling heat transfer in continuous casting as claimed in claim 1, wherein;

the desired amount is in the range of from 6 to 8 ppm.

5. The method of controlling heat transfer in continuous casting as claimed in claim 1, wherein the hydrocarbon is added to the molten metal at a flow rate of 15 SCFM.

6. The method of controlling heat transfer in continuous casting as claimed in claim 1, wherein the hydrocarbon is added to the molten metal at a flow rate of 20 SCFM.

7. A method of controlling heat transfer in continuous casting of metal strip comprising the steps of:

forming a heat of molten metal having a hydrogen level below an a desired amount in a ladle of a metallurgy furnace adapted for use in continuous casting of melt slabs;

increasing the hydrogen level of the molten metal by adding a hydrocarbon to the molten metal in the ladle to provide the desired amount of between 5 and 9 ppm of hydrogen in the molten metal; and delivering the molten metal with increased hydrogen levels into a casting mold and continuously casting molten metal in the casting mold to form a cast strand.

8. The method of controlling heat transfer in continuous casting of metal strip as claimed in claim 7, wherein the hydrocarbon is methane.

9. The method of controlling heat transfer in continuous casting of metal strip as claimed in claim 7, wherein:

the desired amount is in the range of from 6 to 8 ppm.

10. The method of controlling heat transfer in continuous casting of metal strip as claimed in claim 7, wherein the hydrocarbon delivered to the molten metal in the ladle of the metallurgy furnace is stirred at a flow rate of 15 SCFM.

11. The method of controlling heat transfer in continuous casting of metal strip as claimed in claim 7, further comprising cutting the strand at a cutting point to form a slab.

12. The method of controlling heat transfer in continuous casting as claimed in claim 7, wherein the hydrocarbon is stirred into the molten metal through a bottom portion of the ladle.

* * * * *